US009071905B2

(12) United States Patent
Tan et al.

(10) Patent No.: US 9,071,905 B2
(45) Date of Patent: Jun. 30, 2015

(54) SEAL ASSEMBLY FOR AN IN-EAR AND IN-EAR

(71) Applicant: Sennheiser electronic GmbH & Co. KG, Wedemark (DE)

(72) Inventors: Chee Keong Tan, Singapore (SG); Mei Ling Tan, Singapore (SG)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 13/901,773

(22) Filed: May 24, 2013

(65) Prior Publication Data

US 2014/0037123 A1 Feb. 6, 2014

(51) Int. Cl.
*H04R 25/00* (2006.01)
*H04R 1/10* (2006.01)

(52) U.S. Cl.
CPC ..... *H04R 1/1091* (2013.01); *H04R 1/1016* (2013.01)

(58) Field of Classification Search
CPC .... H04R 1/10; H04R 2201/10; H04R 1/1016; H04R 1/1058; H04R 1/1066; H04R 25/65; H04R 25/652; H04R 25/656; H04R 1/1091; H04R 1/1008
See application file for complete search history.

(56) References Cited

U.S. PATENT DOCUMENTS

| | | | | |
|---|---|---|---|---|
| 2,584,402 | A * | 2/1952 | Volkmann | 181/129 |
| 3,935,401 | A * | 1/1976 | Shore et al. | 181/135 |
| 4,055,233 | A | 10/1977 | Huntress | |
| 4,736,435 | A * | 4/1988 | Yokoyama et al. | 381/380 |
| 6,286,622 | B1 | 9/2001 | Tiemann | |
| 6,856,690 | B1 * | 2/2005 | Skulley | 381/371 |
| 2002/0080990 | A1 | 6/2002 | Lin | |
| 2006/0147079 | A1 * | 7/2006 | Jaakkola | 381/380 |
| 2009/0101433 | A1 * | 4/2009 | Stiehl et al. | 181/129 |
| 2009/0285436 | A1 | 11/2009 | Lowry | |
| 2011/0123059 | A1 | 5/2011 | Hu | |

* cited by examiner

*Primary Examiner* — Duc Nguyen
*Assistant Examiner* — Taunya McCarty
(74) *Attorney, Agent, or Firm* — Frommer Lawrence & Haug LLP

(57) ABSTRACT

An in-ear earphone including a housing having a first end for receiving a cable, and a second end which is placed in a concha of a user. Provided at the second end is a sealing unit which seals off an outer end of the ear canal in the region of the concha. The sealing unit has a first and a second end. The sealing unit further has a portion between the first and second ends, wherein both the inside diameter and also the outside diameter of the second end increase in the direction of the second end.

7 Claims, 4 Drawing Sheets

SEAL ASSEMBLY FOR AN IN-EAR AND IN-EAR

The present application claims priority from German Patent Application No. DE 10 2012 209 362.1 filed on Jun. 4, 2012, the disclosure of which is incorporated herein by reference in its entirety.

FIELD OF THE INVENTION

The present invention concerns a sealing unit for an in-ear earphone and an in-ear earphone.

It is noted that citation or identification of any document in this application is not an admission that such document is available as prior art to the present invention.

In-ear earphones are typically placed in the concha of an ear of a user and do not extend into the ear canal. In-ear earphones are enjoying increasing popularity because they are compact and because the earphones are particularly well suited to mobile uses.

U.S. Pat. No. 6,286,622 discloses an ear canal earphone having an ear pad which is fitted into the ear canal of a listener.

In the German patent application from which priority is claimed the German Patent and Trade Mark Office searched the following documents: U.S. Pat. No. 6,286,622 B1, US No 2002/080990 A1, US No 2009/0285436 A1, US No 2011/123059 A1 and U.S. Pat. No. 4,055,233 A.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph) or the EPO (Article 83 of the EPC), such that applicant(s) reserve the right to disclaim, and hereby disclose a disclaimer of, any previously described product, method of making the product, or process of using the product.

SUMMARY OF THE INVENTION

An object of the present invention is to provide an in-ear earphone which is worn in the concha of a user and which enjoys improved sealing.

Thus there is provided an in-ear earphone comprising a housing having a first end for receiving a cable and a second end which is placed in a concha of a user. Provided at the second end is a sealing unit which seals off an outer end of the ear canal in the region of the concha. The sealing unit has a first and a second end. The sealing unit further has a portion between the first and second ends, wherein both the inside diameter and also the outside diameter of the second end increase in the direction of the second end.

In an aspect of the invention the thickness of the second portion is between 0.1 and 0.5 mm.

In a further aspect of the present invention an inside of the second portion includes with the sound output surface an angle of between 100° and 170°.

The invention also concerns an in-ear earphone having a sealing unit as described above.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1A:
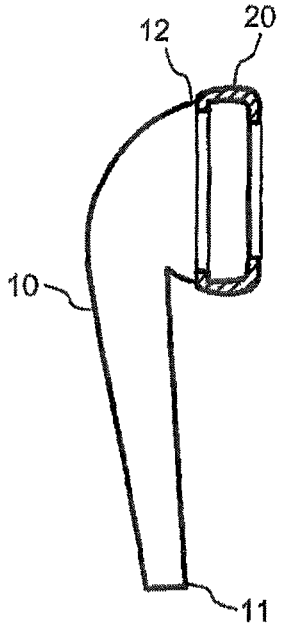
Fig. 1A (prior art)
FIG. 1A shows a diagrammatic view of an in-ear earphone according to the state of the art.

FIG. 1A shows a diagrammatic view of an in-ear earphone according to the state of the art. The in-ear earphone has a housing 10 having a first end 11 for receiving a cable and a second end 12 which can be placed in a concha of a user. To increase wearing comfort, an annular pad 20 of a soft material is fitted over the second end 12 of the housing 10. The pad 20 is shown hatched in cross-section in FIG. 1A.

Figure 1B:
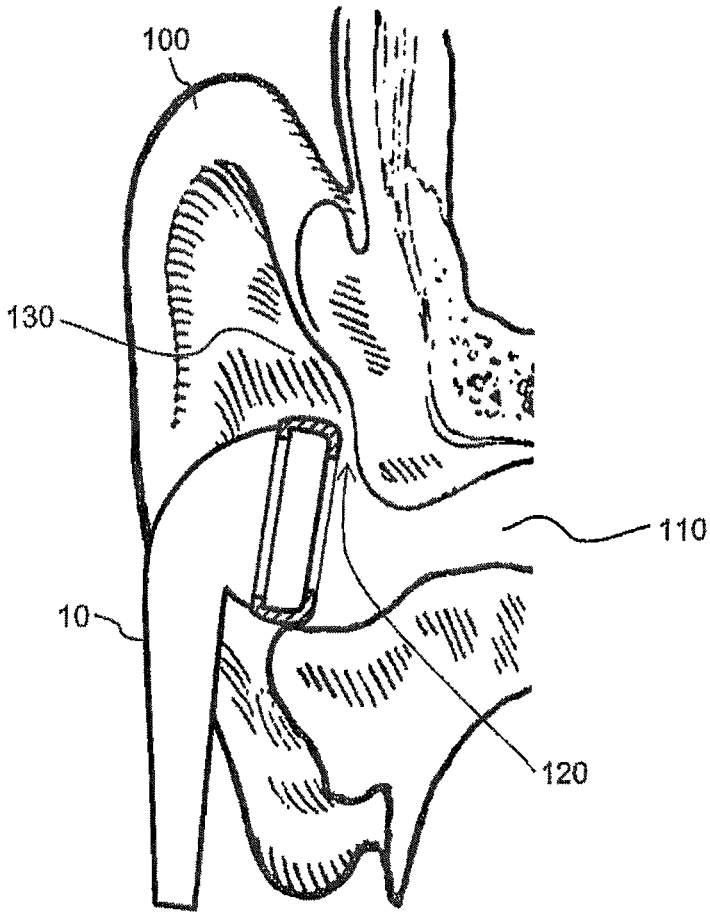
Fig. 1B (prior art)
FIG. 1B shows a diagrammatic view of an in-ear earphone of FIG. 1A in a concha of a user.

FIG. 1B shows a diagrammatic view of the in-ear earphone of FIG. 1A in a concha 130 of an ear 100. The outside diameter of the second end 12 of the housing 10 is so large that it does not fit into an ear canal 110 of a user but rather can be worn in the concha of the user. By virtue of the contour of the concha 130 differing in different people, there are normally gaps 120 over the periphery of the pad 20, and acoustic sealing in relation to the ear canal 110 relative to the surroundings is not afforded at those gaps.

Figure 2A:
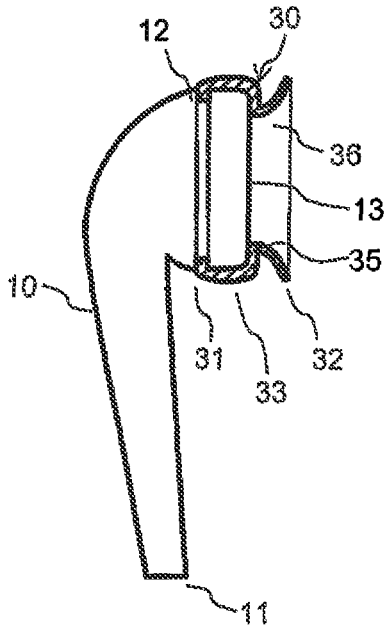
FIG. 2A shows a diagrammatic view of an in-ear earphone according to a first embodiment.

FIG. 2A shows a diagrammatic view of an in-ear earphone according to a first embodiment. The in-ear earphone has a housing 10 having a first end 11 for receiving a cable and a second end 12. An electroacoustic transducer (not shown) can be provided in the region of the second end 12. The earphone further has a sealing unit 30 which is placed in the region of the second end 12.

The sealing unit 30 is made up of a first annular portion 33 and a second annular portion 36. The first portion 33 corresponds to the pad 20 in FIG. 1A and extends from a first end 31 of the sealing unit 30 to an edge 35. That first portion 33 is fitted over the second end 12 of the housing 10. The second portion 36 extends from the edge 35 to a second end 32 of the sealing unit 30.

The in-ear earphone according to the first embodiment has a substantially flat sound output surface 13 at the second end 12 of the housing 10. The sound output surface 13 is substantially round or oval. The sound output surface is of a diameter of between about 8 and 25 mm.

The second annular portion 36 of the sealing unit 30 in the first embodiment is in the form of a peripherally extending sealing lip which can be made from a flexible material. The sealing lip 36 forms a closed contour. The edge 35 bears against the sound output surface 13 and forms a closed contour which surrounds the sound output region. At the edge 35 the sealing lip 36 is of a first inside diameter while at its second end 32 towards the ear it is of a second inside diameter, the second inside diameter being larger than the first inside diameter. The inside diameter of the sealing lip 36 steadily increases in the condition of not being fitted into the ear, with an increasing spacing relative to the sound output surface 13. The end 32 towards the ear, in the condition of not being fitted into the ear, faces in the direction of sound output so that the sealing lip is in peripherally touching contact with the ear of a user upon being inserted into the ear, with its second end 32. The outside diameter of the sealing lip 36 also steadily increases with an increasing spacing relative to the sound output surface 13, in the condition of not being fitted into the ear. The thickness of the sealing lip 36 is preferably of a value of between 0.1 mm and 0.5 mm to ensure good deformability.

Figure 2B:
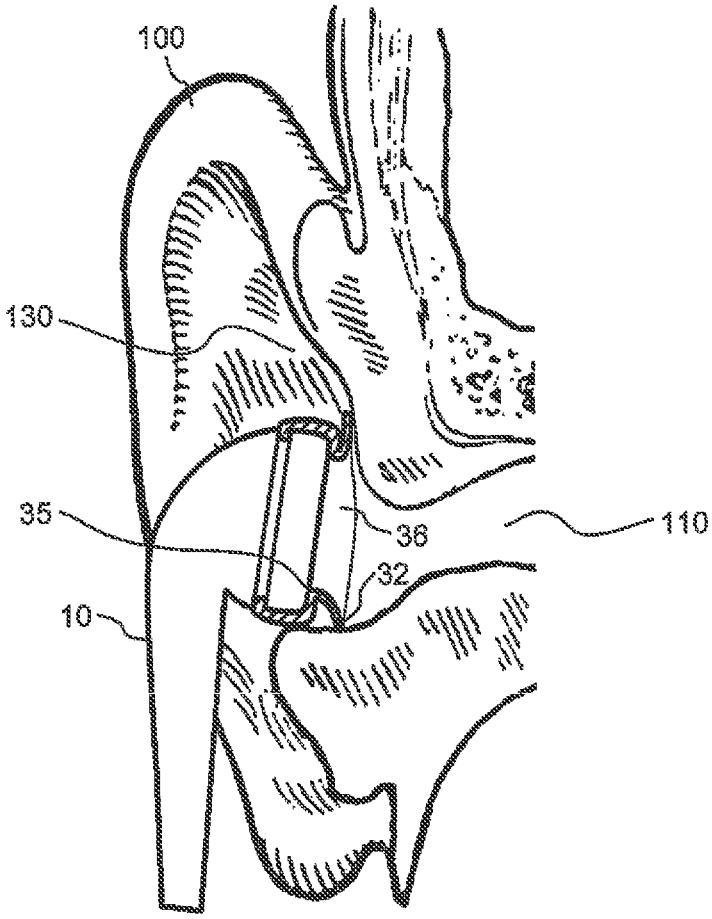
FIG. 2B shows a diagrammatic view of a concha of user with an in-ear earphone according to the first embodiment of FIG. 2A.

FIG. 2B shows a diagrammatic view of a concha of a user with an in-ear earphone according to the first embodiment of FIG. 2A. In FIG. 2B the in-ear earphone of FIG. 2A is placed in a concha 130 of a user. It can be seen in this respect how the sealing lip 36 of the sealing unit 30 can be deformed and then bears in peripheral relationship with the second end 32 against the concha 130 so that the ear canal 110 is sealed off at its outer end.

Sealing of the outer end of the ear canal or the concha can be implemented with the sealing unit 30, more specifically even for conchas of a complex shape. If the sealing lip 36 is made from a soft material the in-ear earphone according to the invention can also enjoy good comfort and can thus be worn even for a prolonged period of time.

The sealing unit 30 can be connected removably or fixedly to the housing 10. If the sealing unit 30 is adapted to be removable then it can be easily cleaned.

The earphone has a sound output surface 13 in the region of the second end 12. The sealing lip 36 touches the sound output surface 13 at the edge 35. The angle which is formed in a sectional view as shown in FIG. 2B between the sound output surface 13 and the inside of the sealing lip 36 is preferably between 100° and 170°.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A sealing unit for an in-ear earphone comprising:

a first annular portion configured to fit onto the in-ear earphone; and a second annular portion configured to be placed in a concha of a user;

wherein the first annular portion has a diameter of between 8 and 25 mm;

wherein the first annular portion and the second annular portion are peripherally connected together at an edge which is configured to surround a sound output region of a substantially flat sound output surface of the in-ear earphone when the sealing unit is fitted onto the in-ear earphone;

wherein the second annular portion is in the form of a peripherally extending sealing lip extending from the edge to a second end of the sealing unit;

wherein the sealing lip is made from a flexible material and configured so that, upon being fitted into the ear, it deforms so that it bears, in peripherally extending relationship with the second end, against the concha of a user so that the ear canal is sealed off at its outer end; and wherein, when the sealing lip is not fitted into the ear, each of an inside diameter and an outside diameter of the sealing lip steadily increases as a distance relative to the sound output surface increases from the edge to the second end of the sealing unit.

2. The sealing unit as set forth in claim 1;

wherein a thickness of the second annular portion is between 0.1 mm and 0.5 mm.

3. The sealing unit as set forth in claim 1;

wherein an inside of the second annular portion forms an angle of between 100° and 170° with the sound output surface.

4. An in-ear earphone comprising:

a sealing unit as set forth in claim 1.

5. The sealing unit as set forth in claim 2;

wherein an inside of the second annular portion forms an angle of between 100° and 170° with the sound output surface.

6. An in-ear earphone comprising:

a sealing unit as set forth in claim 2.

7. An in-ear earphone comprising:

a sealing unit as set forth in claim 3.

* * * * *

UNITED STATES PATENT AND TRADEMARK OFFICE

CERTIFICATE OF CORRECTION

PATENT NO. : 9,071,905 B2
APPLICATION NO. : 13/901773
DATED : June 30, 2015
INVENTOR(S) : Tan et al.

It is certified that error appears in the above-identified patent and that said Letters Patent is hereby corrected as shown below:

Title page item (54) and in the Specification, Column 1, line 1, Title: "Seal Assembly for an in-ear and in-ear" should read --Sealing Unit for an In-Ear Earphone and an In-Ear Earphone--

Specification

In Column 2, line 12, "Fig. 2B shows a diagrammatic view of a concha of user" should read --Fig. 2B shows a diagrammatic view of a concha of a user--

Signed and Sealed this
Eighth Day of March, 2016

Michelle K. Lee

Michelle K. Lee
*Director of the United States Patent and Trademark Office*